United States Patent [19]

Nicolai

[11] Patent Number: 4,942,703

[45] Date of Patent: Jul. 24, 1990

[54] EARTHQUAKE-PROOF ABSORPTION SYSTEM FOR BUILDINGS OR THE LIKE

[76] Inventor: Charles M. Nicolai, P.O. Box 2517, Sausalito, Calif. 94965

[21] Appl. No.: 368,269

[22] Filed: Jun. 19, 1989

[51] Int. Cl.[5] ..... E04B 1/98; E02D 31/08

[52] U.S. Cl. ..... 52/167 R; 52/573; 248/609; 248/615; 248/634

[58] Field of Search ..... 52/167, 573; 248/638, 248/634, 635, 615, 609

[56] References Cited

U.S. PATENT DOCUMENTS

| | | | |
|---|---|---|---|
| 2,702,703 | 2/1955 | Franceschetti | 248/634 |
| 4,633,628 | 1/1987 | Mostaghel | 52/167 |
| 4,718,206 | 1/1988 | Fyfe et al. | 52/167 |
| 4,830,927 | 5/1989 | Fukahori et al. | 248/609 |

*Primary Examiner*—Michael Safavi

*Attorney, Agent, or Firm*—Phillips, Moore, Lempio & Finley

[57] ABSTRACT

An earthquake-proof structure is supported on a foundation by a seismic shock absorption system adapted to isolate the structure from movement of the foundation. The shock absorption system comprises a plurality of elastomeric pads supporting the structure on the foundation to isolate the structure from horizontal and vertical movements imparted to the foundation when the ground areas surrounding the foundation are subjected to seismic activity. The elastomeric pads are secured between the structure, such as a building, and the foundation. The shock absorption system is adapted for use on level ground, as well as for side-hill applications.

19 Claims, 4 Drawing Sheets

FIGURE 5
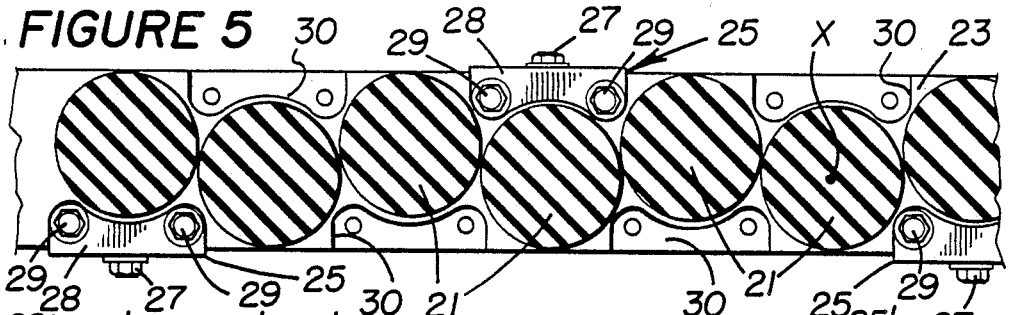
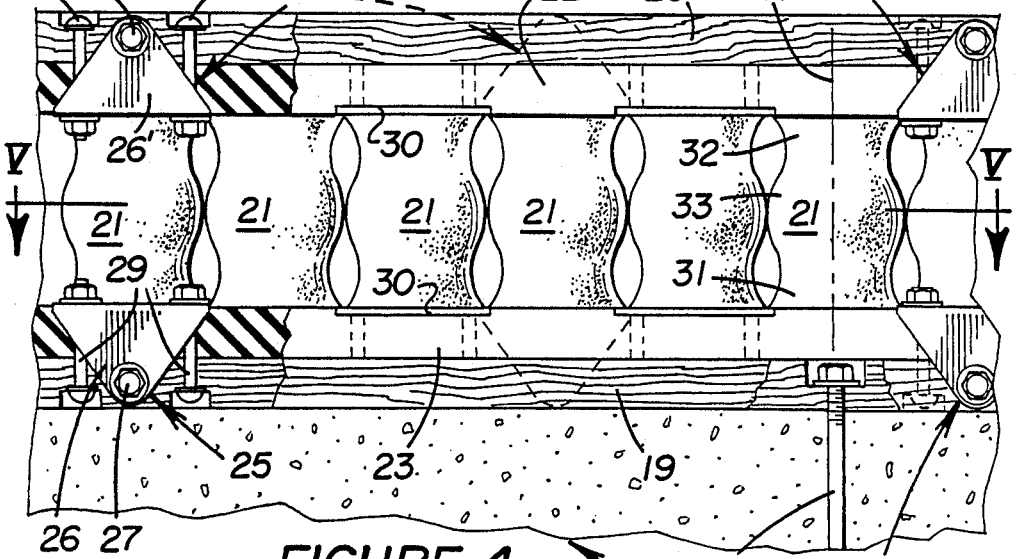
FIGURE 4
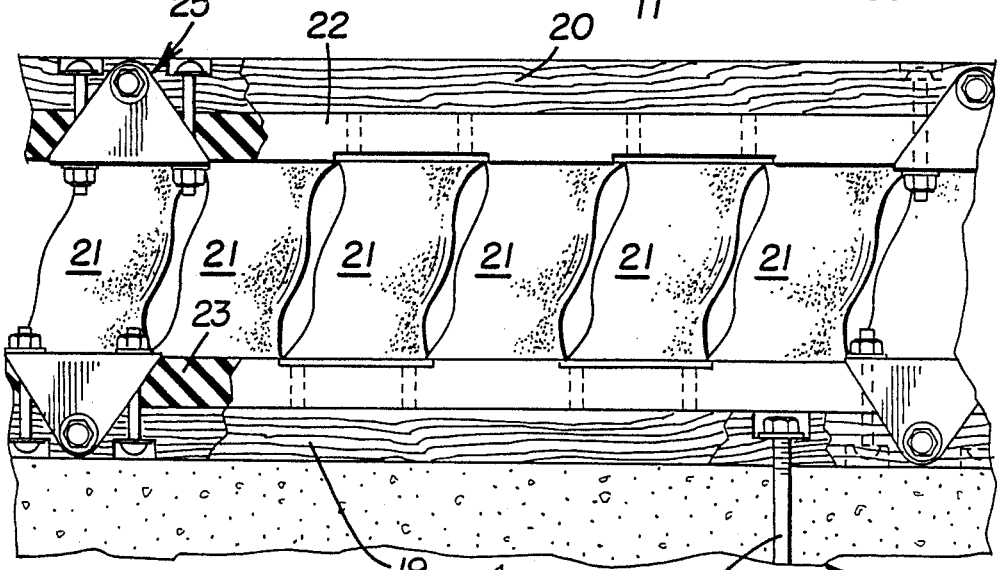
FIGURE 6
S2

EARTHQUAKE-PROOF ABSORPTION SYSTEM FOR BUILDINGS OR THE LIKE

TECHNICAL FIELD

This invention relates generally to an absorption system for earthquake-proofing a supported structure and, more particularly, to an elastomeric cushioning system for isolating a building structure from ground movements resulting from seismic activity.

BACKGROUND OF THE INVENTION

As described in applicant's U.S. Pat. No. 4,517,778, the San Francisco North Quadrangle lies between the active San Andreas and Hayward faults and is within a region of high seismic activity in which earth tremors are frequent and unpredictable. For example, the infamous 1906 earthquake in San Francisco has been extensively documented in many publications, including publications authored by H.O. Wood. The relationship between damage to man-made building structures, foundations, and geology was investigated by Wood, who found that damage to structures was primarily influenced by the constituent makeup of their foundations. Further studies have concluded that the natural periods of vibration of the foundation and the supported structure, as well as the nature of the earthquake vibration and the foundation material, must be considered in the design and construction of buildings and the like.

Wood thus concluded that damage to building structures in the 1906 earthquake were primarily occasioned by the foundations of the buildings. Buildings situated on bedrock and on well-designed and well-placed piles or concrete footings, were found to suffer less damage than buildings erected on soft foundations in landfill areas.

Studies of the above type have given rise to modern-day building techniques, including the driving of piles or support columns into solid ground to support a building structure. However, since the building structure is integrally connected to the foundation and thus the ground proper, vertical, horizontal, and/or inclined faulting will transmit seismic forces to the building structure directly, regardless of the type of foundation and ground makeup.

SUMMARY OF THE INVENTION

An object to this invention is to provide an improved system for supporting and isolating an earthquake-proof structure on a foundation that is subjected to movement due to seismic activity in surrounding ground areas.

The earthquake-proof structure is supported on the foundation by seismic shock absorption means comprising a plurality of elastomeric pad means for isolating the structure from horizontal and vertical movements imparted to the foundation when the ground surrounding the foundation is subjected to seismic activity. Anchoring means secure the elastomeric pad means between the structure and the foundation.

In another aspect to this invention, the shock absorption means comprises a support module, including a plurality of upstanding and at least generally aligned elastomeric columns and elastomeric upper and lower anchor pads secured to the upper and lower ends of the elastomeric columns, respectively. A selected plurality of the module are adapted to be secured between the supported structure and the foundation by the anchoring means.

BRIEF DESCRIPTION OF THE DRAWINGS

Other objects and advantages of this invention will become apparent from the following description and accompanying drawings wherein:

FIG. 4 is an elevational view of the seismic shock absorption system, generally taken in a direction of arrows IV—IV in FIG. 2;

FIG. 5 is a top-plan longitudinal sectional view of the seismic shock absorption system, taken in a direction of arrows V—V in FIG. 4;

FIG. 6 is a view similar to FIG. 4, but illustrates orientation of the building structure and the seismic shock absorption system when a seismic shock $S_2$ is imposed on the foundation longitudinally along the system;

DESCRIPTION OF THE PREFERRED EMBODIMENT

Figure 1:
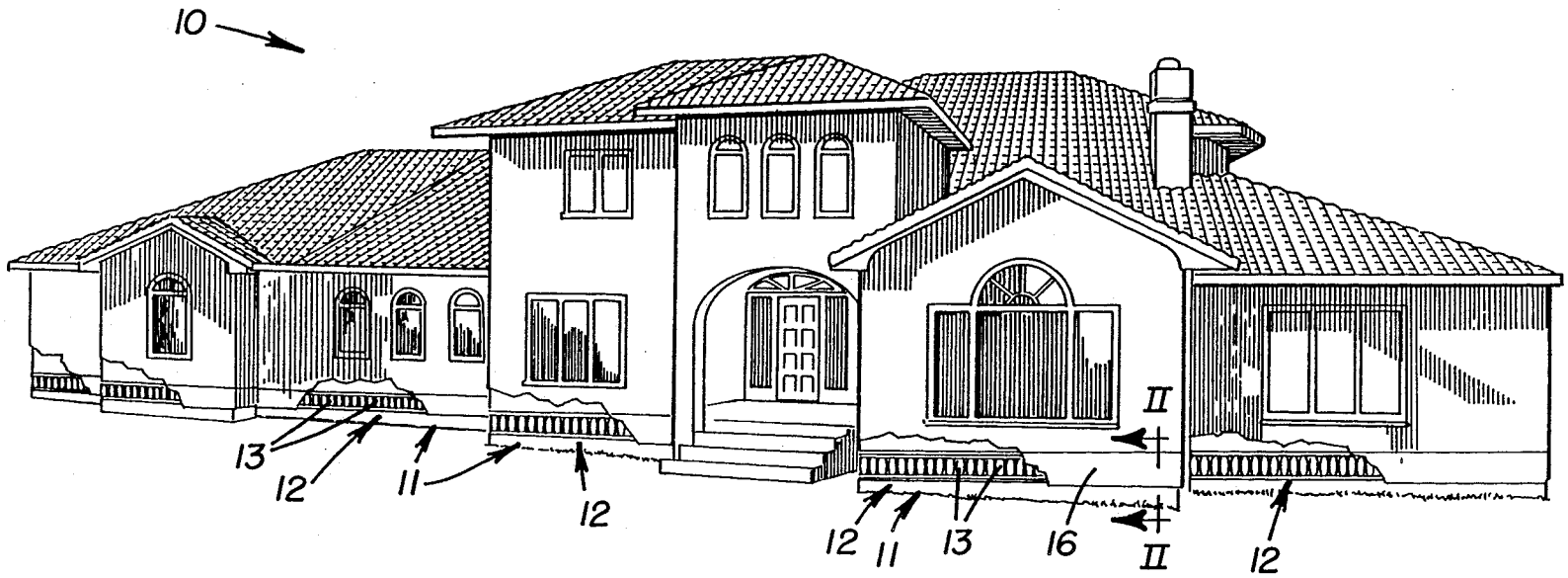
FIG. 1 is a frontal elevational view of a building structure supported on a foundation by a seismic shock absorption system embodying this invention.

FIG. 1 illustrates a building structure in the form of a single-family residence 10 supported on a foundation 11 by a seismic shock absorption system 12. The seismic shock absorption system comprises a plurality of elastomeric pads 13 supporting the building structure on the foundation for isolating the structure from horizontal and vertical movements imparted to the foundation when ground areas surrounding the foundation are subjected to seismic activity. Although the shock absorption system is shown for use with such a building structure, it should be understood that the shock absorption system can be used for supporting other types of buildings and structures, such as heavy machinery, wine casks, etc.

Figure 2:
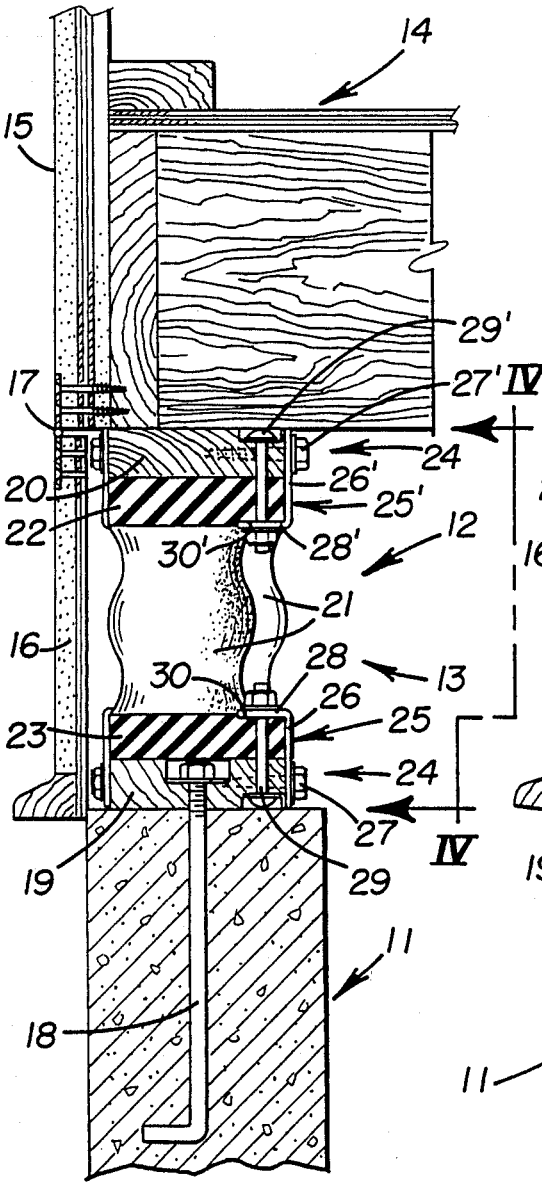
FIG. 2 is an enlarged sectional view, taken in a direction of arrows II—II in FIG. 1 illustrating disposition of the seismic shock absorption system between the building structure and the foundation.

Referring to FIGS. 2–7, building structure 10 comprises a standard floor structure 14 which may comprise a reinforced wooden floor, as shown, or a reinforced concrete slab of standard design. Standard siding 15 is secured exteriorly on the building structure and terminates at its lower end at a perimeter siding panel 16 (FIG. 2). The panel is hingedly connected to the siding by a hinge 17 for purposes hereinafter described.

Figure 3:
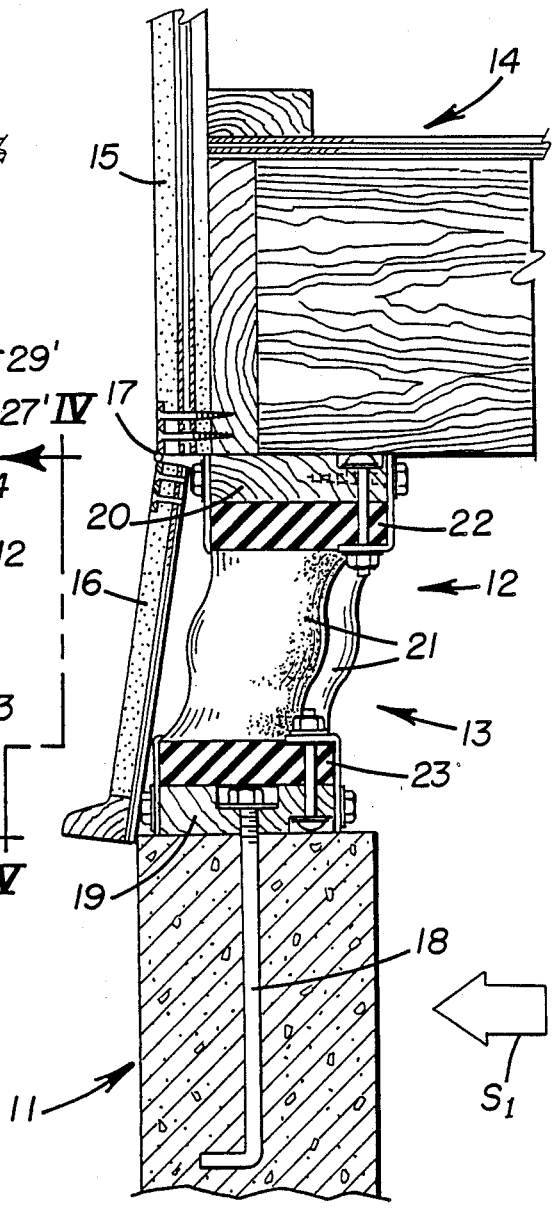
FIG. 3 is a view similar to FIG. 2, but illustrates imposition of a seismic shock $S_1$ on the foundation and resulting orientations of the building structure and the seismic shock absorption system.
Figure 7:
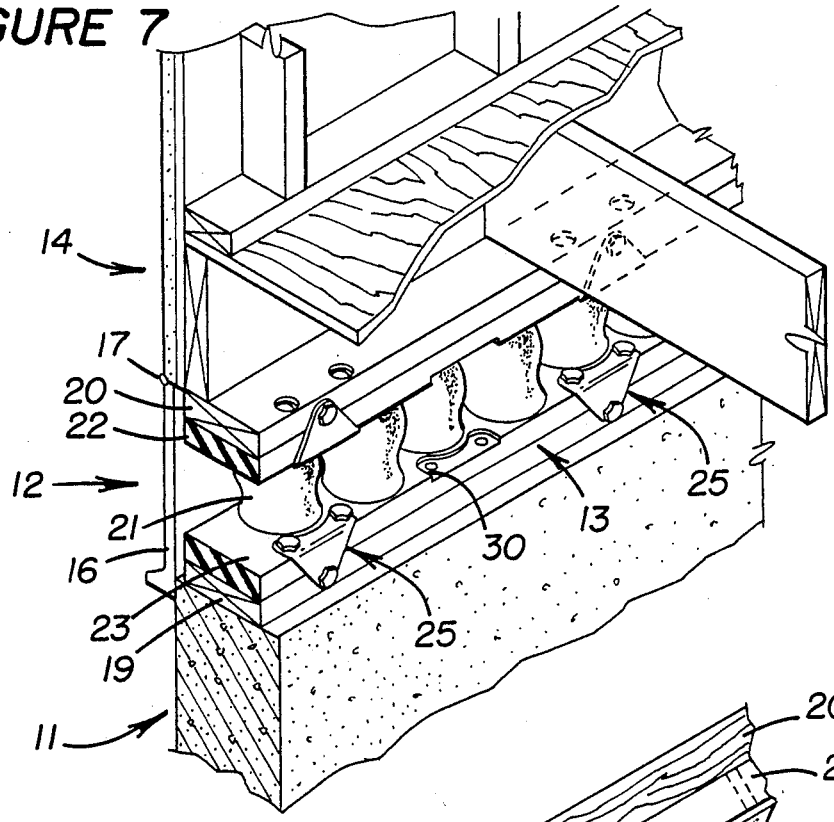
FIG. 7 is an isometric view of the seismic shock absorption system in its supporting relationship between the building structure and the foundation.
Figure 8:
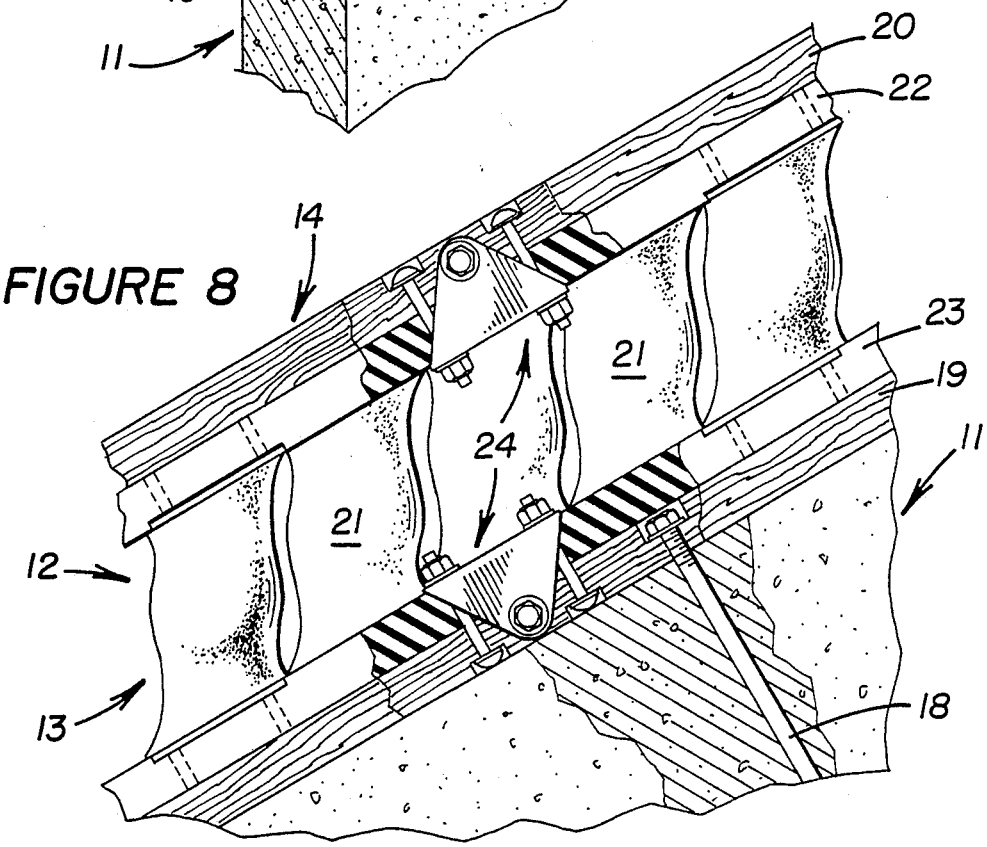
FIG. 8 illustrates an alternate embodiment of this invention wherein the seismic shock absorption system is mounted between a foundation and a building structure, having a side-hill orientation.

Foundation 11 may comprise a standard poured concrete, cinder block, or steel-reinforced concrete slab construction. Suitably spaced anchor bolts 18 are secured within the foundation to secure a standard wooden sill 19 thereon. A similar sill 20 is secured to the underside of floor 14 to overlie sill 19 and to accommodate shock absorption system 12 therebetween. As shown in FIG. 3, when a seismic shock $S_1$ is applied laterally to foundation 11 to move it leftwardly, elastomeric pads 13 of the shock absorption system will be displaced from their vertical dispositions with the building structure, including floor 14, substantially maintaining its original preset position. Siding panel 16 will pivot at piano hinge 17 to accommodate such movement.

Referring to FIGS. 2, 4, 5 and 7, each elastomeric pad 13 is in the form of a support module including a selected plurality (e.g., eight) of upstanding and generally aligned elastomeric columns 21. The columns are secured between elastomeric upper and lower anchor pads 22 and 23, respectively, each secured to a respective sill 19 or 20 by anchoring means 24. Elastomeric columns 21 and anchor pads 22 and 23 are preferably integrally molded to form a unitary construction.

Pad means 13 is entirely composed of an elastomeric material exhibiting sufficient flexibility, hardness, modulus and related physical characteristics to provide the functional desiderata herein described. For example, the pads can be entirely composed of a suitable thermoplastic elastomer (TPE) which exhibits physical properties similar to those of vulcanized rubbers, but which can be made on thermoplastic equipment. For example, styrene/elastomer block copolymers or thermoplastic polyurethanes and polyester/polyethers, either unmodified or suitably modified by fillers or extenders, are suitable for this purpose.

As shown in FIGS. 2, 4, 5 and 7, anchoring means 24 comprises a plurality of longitudinally spaced lower brackets 25 each including a vertically disposed flange 26 having its lower end secured to one side of sill 19 by a lag screw 27. A horizontally disposed flange 28 of the bracket overlies the sill and is secured thereto by a pair of longitudinally spaced bolts 29 to provide fastening means extending through the flange, anchor pad 23 and sill 19. As shown in FIG. 2, a cut-out is formed in anchor pad 23 to define a recess 30 on the upper side thereof having flange 28 of the bracket nested therein.

Referring to FIGS. 4 and 5, each elastomeric column 21 is disposed on a longitudinal axis X thereof with the axes of each adjacent pair of the columns being offset laterally from each other, relative to the direction of the longitudinal alignment. As further shown in FIGS. 2, 4 and 5, an upper bracket 25', identical to bracket 25, is vertically aligned with a respective lower bracket 25 to secure the upper end of pad 13 to upper sill 20 of building structure 10. In particular, bracket 25' includes a flange 26' secured to an inner side of sill 20 by a lag bolt 27' and a second flange 28' disposed within a recess 30' defined on the underside of anchor pad 22 and secured in place by a pair of bolts 29'.

The adjacent offset of elastomeric columns 21 (FIG. 5) thus facilitates the securance of brackets 25 and 25' at strategic locations, insuring fixed securance of the pads in place. In particular, a first pair of vertically aligned brackets 25,25' securing one of the columns in place are disposed on a first lateral side of the columns whereas a next adjacent second pair of vertically aligned brackets are disposed on a second lateral side of the columns, opposite to the first side thereof. It should be further noted in FIGS. 4 and 5 that the columns are closely spaced relative to each other to form an integrated support system insuring full support of the building structure.

As further shown in FIGS. 2, 4, 5 and 7, each elastomeric column 21, when viewed in longitudinal cross-section, has a generally double hour-glass shape. Opposite end portions 31 and 32 of each column are each flared outwardly from axis X of the column with an intermediate portion 33, between the end portions, being bulged outwardly from the axis to define annular concavities between the intermediate portion and the end portions. In the preferred embodiment of this invention, each of the columns has a circular cross-section throughout its length. However, it should be understood that other cross-sections (elliptical, square, etc.) can be utilized for particular applications of this invention.

The seismic shock absorption system of this invention can be utilized to support newly built building structures or can be used as a retrofit to support older building structures. In the later application, the building structure would be suitably raised to accommodate the system and the system would be secured in place in the manner described above. As stated above, the seismic shock absorption system of this invention can likewise be used for supporting other types of buildings and structures, such as heavy machinery, wine casks, etc.

I claim:

1. An earthquake-proof structure supported on a foundation by seismic shock absorption means for isolating said structure from movements of said foundation, said seismic shock absorption means comprising a plurality of elastomeric pad means supporting said structure on said foundation for isolating said structure from horizontal and vertical movements imparted to said foundation when ground surrounding said foundation is subjected to seismic activity, said elastomeric pad means comprising a plurality of upstanding and at least generally aligned elastomeric columns secured between elastomeric upper and lower anchor pads, and anchoring means for securing said elastomeric pad means between said structure and said foundation, said anchoring means securing said upper and lower elastomeric anchor pads to said structure and to said foundation, respectively, and comprising a pair of brackets each having a first flange disposed on an underside of said elastomeric upper anchor pad and on an upper side of said elastomeric lower anchor pad, respectively, and fastening means extending through each said first flange and a respective one of said elastomeric upper and lower anchor pads and secured to a respective one of said structure and said foundation.

2. The combination of claim 1 wherein said elastomeric columns and said elastomeric upper and lower anchor pads are integrally molded to form a unitary construction.

3. The combination of claim 1 wherein each of said elastomeric columns is disposed on a longitudinal axis thereof and the axes of an adjacent pair of said columns are offset laterally from each other relative to either of two actual alignments formed by every other column.

4. The combination of claim 1 further comprising cut-out means defining a recess on each of the underside of said elastomeric upper anchor pad and on the upperside of said elastomeric lower anchor pad and wherein a respective said first flange is nested within each said recess.

5. The combination of claim 1 wherein a said pair of brackets are secured by said fastening means to said structure and said foundation, closely adjacent to each of said elastomeric columns.

6. The combination of claim 5 wherein a first pair of vertically aligned brackets, securing said elastomeric upper anchor pad to said structure and said lower anchor pad to said foundation, are disposed on a first lateral side of said columns and a second pair of next adjacent vertically aligned brackets, securing said elastomeric upper anchor pad to said structure and said lower anchor pad to said foundation, are disposed on a second lateral side of said columns, opposite to the first side thereof.

7. The combination of claim 1 wherein each of said elastomeric columns is disposed on a longitudinal axis thereof and the outer surface of said column, when viewed in longitudinal cross-section, has a generally double hour-glass shape with its opposite end portions being flared outwardly from said axis and its intermediate portion, between said end portions, being bulged outwardly from said axis to define concavities between said intermediate portion and each of said end portions.

8. The combination of claim 7 wherein each adjacent pair of said elastomeric columns are closely spaced together.

9. The combination of claim 7 wherein each said column has a circular cross-section.

10. A support module for supporting and isolating a structure from ground movements occasioned by seismic activity comprising a plurality of upstanding and generally aligned elastomeric columns, each of said elastomeric columns being disposed on a longitudinal axis thereof and the outer surface of said column, when viewed in longitudinal cross-section, has a generally double hour-glass shape with its opposite end portions being flared outwardly from said axis and its intermediate portion, between said end portions, being bulged outwardly from said axis to define concavities between said intermediate portion and each of said end portions, and elastomeric upper and lower anchor pads secured to upper and lower ends of said elastomeric columns, respectively.

11. The support module of claim 10 further comprising means for securing said elastomeric pad means between a supported structure and a foundation.

12. The support module of claim 10 wherein said elastomeric columns and said elastomeric upper and lower anchor pads are integrally molded to form a unitary construction.

13. The support module of claim 10 wherein each adjacent pair of said columns are offset laterally from each other relative to either of two actual alignments formed by every other column.

14. The support module of claim 10 further comprising cut-out means defining recesses defined on an underside of said elastomeric upper anchor pad and on an upperside of said elastomeric lower anchor pad, each of said recesses adapted to receive a flange of a mounting bracket in nested relationship therein.

15. THe support module of claim 14 wherein a first pair of vertically aligned recesses are disposed on a first lateral side of said columns and a second pair of vertically aligned recesses are disposed on a second lateral side of said columns, opposite to the first side thereof.

16. The support module of claim 10 wherein each adjacent pair of said elastomeric columns are closely spaced together.

17. The support module of claim 10 wherein each said column has a circular cross-section.

18. An earthquake-proof structure supported on a foundation by seismic shock absorption means for isolating said structure from movements of said foundation, said seismic shock absorption means comprising a plurality of elastomeric pad means supporting said structure on said foundation for isolating said structure from horizontal and vertical movements imparted to said foundation when ground surrounding said foundation is subjected to seismic activity, said elastomeric pad means comprising a plurality of upstanding and at least generally aligned elastomeric columns secured between elastomeric upper and lower anchor pads, wherein each of said elastomeric columns is disposed on a longitudinal axis thereof and the outer surface of said column, when viewed in longitudinal cross-section, has a generally double hour-glass shape with its opposite end portions being flared outwardly from said axis and its intermediate portion, between said end portions, being bulged outwardly from said axis to define concavities between said intermediate portion and each of said end portions, and anchoring means for securing said elastomeric pad means between said structure and said foundation, said anchoring means securing said upper and lower elastomeric anchor pads to said structure and to said foundation, respectively.

19. A support module for supporting and isolating a structure from ground movement occasioned by seismic activity comprising a plurality of upstanding and generally aligned elastomeric columns, and elastomeric upper and lower anchor pads secured to upper and lower ends of said elastomeric columns, respectively, and cut-out means defining recesses on an underside of said elastomeric upper anchor pad and on an upperside of said elastomeric lower anchor pad, each of said recesses adapted to receive a flange of a mounting bracket in nested relationship therein.

* * * * *